US005952077A

United States Patent [19]

Booth et al.

[11] Patent Number: 5,952,077

[45] Date of Patent: Sep. 14, 1999

[54] SURFACTANT COMPOSITIONS

[75] Inventors: David John Booth; Martin Spencer Williams, both of Cleveland, United Kingdom

[73] Assignee: Imperial Chemical Industries PLC, London, United Kingdom

[21] Appl. No.: 08/860,849

[22] PCT Filed: Jan. 3, 1996

[86] PCT No.: PCT/GB96/00005

§ 371 Date: Aug. 26, 1997

§ 102(e) Date: Aug. 26, 1997

[87] PCT Pub. No.: WO96/21668

PCT Pub. Date: Jul. 18, 1996

[30] Foreign Application Priority Data

Jan. 13, 1995 [GB] United Kingdom ..... 9500638
Aug. 22, 1995 [GB] United Kingdom ..... 9517176

[51] Int. Cl.[6] ..... C08K 5/06; C08K 5/09

[52] U.S. Cl. ..... 428/97; 428/95; 428/96; 442/99; 442/164; 442/401; 524/755; 524/773; 524/837; 524/863; 524/864

[58] Field of Search ..... 428/95, 96, 97; 442/99, 164, 401; 524/755, 773, 837, 863, 864

[56] References Cited

U.S. PATENT DOCUMENTS 5,258,451 11/1993 Ohsawa et al. ..... 524/755

FOREIGN PATENT DOCUMENTS 0 313 227 4/1989 European Pat. Off. .
0 605 727 7/1994 European Pat. Off. .

*Primary Examiner*—Terrel Morris

[57] ABSTRACT

Surfactant compositions including end-capped hydrocarbyl polyalkoxylate and/or fatty acid polyalkoxylate and organopolysiloxane having one or more polyoxyalkylene side chains are good immediate and long term spreaders particularly on fibrous hydrophobic synthetic polymeric substrates such as spun-bonded, non-woven materials made e.g. form polyolefins, especially polypropylene, or PET. Particularly useful alkoxylates are of one of the formulae (Ia to Id): $R^1O.(AO^1)_n.R^2$ (Ia); $R^3.CO_2.(AO^1)_n.R^2$ (Ib); $R^{14}O.[EO_i.PO_j].R^{15}$ (Ic); or $R^{14}O.(AO^2)_k.(AO^3)_l.(AO^2)_m.R^{15}$ (Id), where the various substituents and indices have defined meanings and useful silicones include those of the formula (II): $R^4{}_3SiO.[R^4{}_2SiO]_x.\{(R^4Si[(O.R^5.(AO^2)_m.R^6]O\}_y.SiR^4{}_3$, where the various substituents and indices have defined meanings. Usually the coating compositions will include specific active materials particularly lubricants especially alkoxylate lubricants. The compositions are water compatible (dispersible or soluble) and primarily biodegradable. The coated substrates find application as carpet backing and geotextiles. In carpet backing, the water compatibility of the compositions makes it possible to avoid tip frosting of carpet on subsequent dyeing.

37 Claims, No Drawings

SURFACTANT COMPOSITIONS

This invention relates to surfactant compositions and in particular to a composition including a combination of components which provides a vehicle for materials applied to substrates, particularly yams, fibers, tapes and/or textiles and which provides both good immediate spreading and good long term spreading, to formulations for treating such substrates based on the composition and to substrates treated using the composition or formulations based on it.

It is well known to apply materials to substrates, particularly textiles, and the yams, fibers and/or tapes used in making textiles and similar products, to produce beneficial effects either on the properties of the materials or in processing them. A practical requirement in such treatment is that the material should spread over the surface of the substrate. Particularly where the substrate is a pre-formed textile material, the apparent surface is much smaller than the total surface area of the yam or fibre from which it is made and this is significant where the material applied to the substrate is required to spread over the whole surface of the yam and/or fibre and/or tape surface to be fully effective. This spreading over the individual yams and/or fibers is in addition to the first stage spreading needed to coat the apparent surface of the substrate uniformly. Similar requirements can be met in other areas especially of coating e.g. coating film materials, but usually it is not as severe as with textiles as the apparent surface area is much closer to the total surface area.

Among the treatments applied to such substrates are the types of material described as 'spin finishes'. Typically, spin finishes are applied to fibers or yams mainly to improve their lubricity so as to speed or ease machine handling during the manufacture of articles, particularly textile articles from the yam or fibre and, thus, commonly spin finish compositions include lubricants.

The treatment e.g. by the application of spin finish materials, of hydrophobic fibers, yams and tapes, particularly of polyolefins, such as polypropylene, and polyesters, can be particularly difficult because most conventional treatment materials are relatively hydrophilic and do not work well on the hydrophobic polymer surface. Hydrophobic materials have been used to treat hydrophobic substrates and technically they can perform their primary function well, although they tend to be relatively expensive. Unfortunately, such hydrophobic materials tend not to be readily biodegradable, in part because they are hydrophobic, and this makes effluent treatment relatively difficult and expensive. Further, their hydrophobicity and consequent incompatibility with water may give rise to down stream processing problems and make effluent treatment more complex. One commercially important use of hydrophobic fibers is as carpet backing especially for tufted carpets. In this use, the carpet backing is now often made of polypropylene and such carpet backing can be made by weaving polypropylene fibre or, more usually, tape e.g. made by splitting stretched film, or using spun-bonded non-woven materials made from polymer fibre. One difficulty with polypropylene carpet backing, whether woven or non-woven, but particularly with spun-bonded non-woven material, is that it can be damaged by the needles used in the tufting process. This problem can be met by lubricating the carpet backing before tufting. The lubricant reduces frictional forces between the polymer and the needle and reduces the damage to the polymer fibre or tape during tufting. Such materials are commonly considered to be a variety of 'spin finish' although they are usually applied to the pre-formed textile rather than to the fibre or tape used to make the textile subsequently.

Suitable lubricants particularly based on silicone polymers, are available, but they are expensive specialty chemicals and are not water soluble or dispersible, which limits their bio-degradability. A further problem with such non-water soluble silicone polymers is that after tuning, some of the silicone may migrate from the carpet backing to the top of the pile e.g. during storage in rolls of carpet. The presence of water insoluble silicone polymers on the fibers of the carpet pile can interfere with dyeing of the carpet giving rise to 'tip frosting' where the tips of the pile are underdyed and appear pale. Analogous problems can be encountered when other auxiliaries are applied to fibers, yams or textiles.

The present invention is based on our discovery of a water compatible mixed surfactant composition which has good immediate and long term spreading properties, especially on textile materials, and which can act as a vehicle for other components particularly, but not restricted to, lubricants. The components of the composition include an end-capped hydrocarbyl or fatty acid polyoxyalkylene derivative and an organopolysiloxane having polyoxyalkylene side chains.

The present invention accordingly provides a water compatible surfactant composition which comprises:

i at least one end-capped hydrocarbyl polyalkoxylate and/or at least one fatty acid polyalkoxylate; and ii at least one organopolysiloxane having one or more polyoxyalkylene side chains.

The end-capped hydrocarbyl polyalkoxylate can be a lower, particularly $C_{1\ to\ 6}$, alkyl, especially methyl or ethyl, end-capped alcohol alkoxylate, particularly an ethoxylate, or an end-capped ethylene oxide propylene oxide (EO/PO) copolymer and the end-capped fatty acid polyalkoxylate is typically a lower, particularly $C_{1\ to\ 6}$, alkyl, especially methyl or ethyl, end-capped fatty acid alkoxylate, particularly an ethoxylate. End-capped alcohol alkoxylates useful in the invention include those of the formula (Ia) and end-capped fatty acid polyalkoxylate include those of the formula (Ib) respectively:

$$R^1O.(AO^1)_n.R^2 \quad \text{(Ia)}$$

or $$R^3.CO_2.(AO^1)_n.R^2 \quad \text{(Ib)}$$

where $R^1$ is a $C_{4\ to\ 22}$ hydrocarbyl group, particularly a $C_{8\ to\ 20}$ alkyl or $C_{7\ to\ 16}$ alkylphenyl group;

$R^3$ is a $C_{6\ to\ 20}$, particularly a $C_{8\ to\ 18}$, fatty acid residue;

$AO^1$ is an alkylene oxide, particularly ethylene oxide and/or propylene oxide, residue and may vary along the chain;

n is from 2 to 25, typically from 3 to 15; and $R^2$ is a $C_{1\ to\ 10}$ hydrocarbyl group, particularly a $C_{1\ to\ 6}$ alkyl or $C_{7\ to\ 10}$ aralkyl, especially phenylalkyl, group.

In the formula (Ia) the group $R^1$ is a $C_{4\ to\ 22}$ hydrocarbyl group, particularly a $C_{8\ to\ 20}$ alkyl or $C_{7\ to\ 16}$ alkylphenyl group. Particularly desirably it is a $C_{8\ to\ 20}$ alkyl group i.e. the compound is based on an alkoxylated $C_{8\ to\ 20}$ fatty alcohol. In the formula (Ib) the group $R^3$ is a $C_{10\ to\ 20}$, particularly a $C_{12\ to\ 18}$, usually a saturated and especially an alkyl, hydrocarbyl group of a fatty acid. Desirably, the residues $AO^1$ are ethylene oxide residues so that the alkoxylation is ethoxylation, but propylene oxide residues can be included in the chain. Generally, biodegradability and water solubility are both reduced with increasing propylene oxide residue content (for a given number of alkylene oxide residues). Biodegradability is also adversely affected if the propylene oxide units (when present) are at the end of the chain remote from the hydrocarbyl or fatty acid residue (in formulae Ia and Ib respectively) and usually the compounds used will not have propylene oxide residues at that end of the chain. The alkylene oxide chain contains from 2 to 25 alkylene oxide residues and particularly suitable materials have from 3 to 15, especially about 6 ethylene oxide residues per molecule.

The end-capping group $R^2$ is a $C_{1\ to\ 10}$ hydrocarbyl group. When it is a relatively short chain alkyl group e.g. a $C_{1\ to\ 6}$ alkyl, especially a methyl or ethyl group, its main purpose is to cap the chain and adjust the hydrophilicity of the compound. When it is longer chain alkyl group e.g. a $C_{6\ to\ 10}$ alkyl group or an $C_{7\ to\ 10}$ aralkyl, particularly phenylalkyl group, it has the additional property of acting as a secondary hydrophobe. This may enable the properties of the composition to be adjusted to suit particular applications.

The end-capped hydrocarbyl polyalkoxylate can also be an end-capped ethylene oxide/propylene oxide copolymer. The copolymer can be a random copolymer or, and preferably a block copolymer. The end-capping groups are typically lower, particularly $C_1$ to $C_6$, alkyl, especially methyl or ethyl groups. End-capped ethylene oxide/propylene oxide random copolymers useful in the invention include those of the formula (Ic) and end-capped ethylene oxide/propylene oxide block copolymers useful in the invention include those of the formula (Id) respectively:

$$R^{14}O.[EO_i.PO_j].R^{15} \quad \text{(Ic)}$$

$$R^{14}O.(AO^2)_k.(AO^3)_l.(AO^2)_m.R^{15} \quad \text{(Id)}$$

where $R^{14}$ and $R^{15}$ are each independently $C_{1\ to\ 6}$ alkyl groups;

EO is an ethylene oxide residue;

PO is a propylene oxide residue;

$AO^2$ is an ethylene oxide or propylene oxide residue $AO^3$ is an ethylene oxide or propylene oxide residue, but is different from $AO^2$ i is from 10 to 40;

j is from 10 to 30;

k and m are each from 0 to 30 and k+m is from 10 to 40; and l is from 10 to 30

In the formula (Ic) The end-capping groups $R^{11}$ and $R^{12}$ are each $C_{1\ to\ 6}$ alkyl, especially methyl or ethyl, groups. The indices i, j, k, l and m are, within the ranges stated, such that the compound is, at least in formulation, compatible with water and preferably water soluble or dispersible. Typically i and k+m are each from 15 to 30, particularly 20 to 25, with k and m being 0 or from 5 to 20, but where the block copolymer is a ternary copolymer usually each of k and m is approximately half the total k+m, and j and l are each from 10 to 20. The formula (Id) for block copolymers includes materials having a binary block structure i.e. an EO block linked to a PO block, and ternary block structures i.e. a central block of one of EO and PO and two terminal blocks linked to the central block of the other of EO and PO. These latter are the materials commonly referred to as EO/PO block copolymers. Typically the end-capped derivatives used in the invention can be made starting with a polypropylene glycol ($HO.PO_l.H$), reacting this with ethylene oxide (an average of k+m moles) to form a ternary block copolymer and subsequently end-capping the copolymer to form the compound of the formula (Id). Suitable examples of such materials include the di-methyl capped $EO_{22}/PO_{16}$ (EO.PO.EO temary) block copolymer.

It is an aspect of this invention that the end-capped hydrocarbyl or fatty acid polyalkoxylate is or includes one or more compounds of the formula (Ia), (Ib), (Ic) or (Id).

The organopolysiloxane having one or more polyoxyalkylene side chains is a copolymer containing organopolysiloxane and polyoxyalkylene chains. Usually such polymers are made by a graft polymerisation technique and for convenience we refer to this material as a graft copolymer. These graft copolymers are sometimes referred to as "silicone glycols" and we use this term for convenience herein. The silicone glycol used in this invention typically has the formula (II):

$$R^4{}_3SiO.[R^4{}_2SiO]_x.\{(R^4Si[(O.R^5.(AO^2)_m.R^6]O\}_y.SiR^4{}_3 \quad \text{(II)}$$

where $R^4$ is an alkyl group and may vary along the polymer chain, but is usually uniformly methyl;

x is from 30 to 300. more usually from 50 to 200;

y is from 1 to 25, usually at least 5 and particularly from 10 to 15;

$R^5$ is a $C_{3\ to\ 6}$ alkylene group, particularly a propylene group;

$AO^2$ is an alkylene oxide, particularly ethylene oxide and/or propylene oxide, residue and may, and usually will, vary along the chain;

m is from 50 to 200, particularly from 80 to 150: and $R^6$ is a hydrogen atom, a $C_{1\ to\ 18}$ hydrocarbyl group, particularly a $C_{1\ to\ 6}$ alkyl, group or a $C_{2\ to\ 10}$ acyl group.

Typically, the silicone glycol has a molecular weight of from 50 to 100 kD, more usually from 70 to 90 kD. The silicone polymer chain typically contains from about 30 to about 300, and more usually from 50 to 200, siloxane repeat units. The $C_{3\ to\ 6}$ alkylene group(s) $R^5$ link the silicone polymeric backbone to the polyoxyalkylene side chain(s) and typically are 1,3-propylene group(s). The residues $AO^2$ are typically ethylene and/or propylene oxide residues. The polyoxyalkylene chain will usually include a substantial proportion of ethylene oxide residues so that the polymer is relatively hydrophilic. The molar proportion of ethylene oxide residues is typically from 25 to 100%, particularly about 50%, the remainder usually being propylene oxide residues. When the polyoxyalkylene side chain contains propylene oxide residues, the chain will usually be terminated by one or more propylene oxide residues. The polyoxyalkylene side chain(s) are typically relatively long e.g. 50 to 200, particularly from 80 to 150, alkylene oxide residues and correspondingly have molecular weights typically of from about 2500 to 10000. The number of polyoxyalkylene side chain bearing residues is typically more than 2, usually at least 5 and more usually from 10 to 15.

The group(s) $R^6$ terminate the polyoxyalkylene side chain (s) and can be hydrogen, $C_{1\ to\ 18}$ hydrocarbyl, particularly alkyl, group(s) or $C_{2\ to\ 10}$ acyl group(s). Generally, although hydrogen termination gives more hydrophilic co-polymers, the side chains will be end-capped particularly with short chain alkyl e.g. a methyl or ethyl, group(s), or short chain acyl, such as an acetyl or propionyl, groups.

It is an aspect of this invention that the organopolysiloxane having one or more polyoxyalkylene side chains is one or more compounds of the formula (II). It is a further aspect of this invention that the end-capped hydrocarbyl or fatty acid polyalkoxylate is one or more compounds of the formula (Ia), (Ib), (Ic) or (Id) and the organopolysiloxane having one or more polyoxyalkylene side chains is one or more compounds of the formula (II).

The composition of the invention is water compatible, by which we mean that, at a concentration of at least 1% by weight, the composition is either soluble in water, or the composition is readily dispersible in water to form a colloidal or near colloidal dispersion or emulsion. Usually the individual components of the composition are themselves water compatible, but components which are not themselves water compatible may be solublised by other components of the composition so that the overall composition is water compatible. Desirably, the end-capped hydrocarbyl or fatty acid polyoxyalkylene derivatives or end-capped EO/PO block or random copolymers used in the invention are water soluble. The silicone glycols are typically readily dispersible in water but are often not truly water soluble. In some cases, even insoluble or non-dispersible components of the formulation may be used where the component(s) of the formulation combine to give a water compatible system. We expect that this will be most likely for the silicone glycol as it is typically used in a relatively low concentration as compared with the end-capped hydrocarbyl or fatty acid polyoxyalkylene derivative and the latter (or other components of the composition) may act to make it readily water dispersible. In any event we have not experienced difficulties in making compositions that are water compatible.

As those skilled in the art know, numbers of repeat units in polymers, including the numbers of alkylene oxide residues, in the polymers and chains referred to herein are average values which may be non-integral.

The relatively simple composition including components selected from the two classes set out above can provide good immediate and long term spreading properties especially over hydrophobic synthetic polymer surfaces, especially of fibers such as those of polyolefins, particularly polypropylene, polyamides such as nylon, polyesters such as polyethylene terephthalate (PET) and its related co-polymers and acrylic polymers and copolymers. Substrates of polyolefin polymers, especially polypropylene, are particularly suitable for treatment using the compositions of the invention. Such 'simple' formulations can be of just two components or of mixtures of components of the two types. For convenience, this composition is referred to herein as a two component composition or a two component spreading vehicle.

They can also be usefully used on blends of one or more such hydrophobic polymers, with natural polymers such as cellulosic materials such as cotton and polyamide (protein) materials such as wool or silk. Other possible substrates include films and tapes made from such polymeric materials.

The term 'immediate spreading' in relation to the properties of the composition refers to the ability of the composition to spread over the surface of the bulk substrate on application. The term 'long term spreading' refers to the ability of the composition to spread over the surface of the individual components, particularly fibers, of the substrate over a period of up to several days to a few weeks after coating onto the substrate.

Accordingly, the invention includes a substrate, particularly a hydrophobic synthetic polymer substrate and especially such a substrate where the polymer is in fibre form, coated with a composition of the invention, which can be the two component composition or a composition including other components.

Where the composition includes a compound of the formula (Ia), particularly where the group $R^1$ has a relatively long, particularly $C_8$ or longer, chain, especially an alkyl chain, we have found that it may give rise to swelling of polyolefin, particularly polypropylene substrates. In some applications this may lead to undesirable dimensional changes in the treated substrate. Compositions using compounds of the formula (Ic) and especially (Id) [and possible also of the formula (Ib)] appear not to suffer from this potential disadvantage and may be preferred in some such applications. The invention accordingly includes a substrate, particularly a hydrophobic synthetic polymer substrate, particularly a polyolefin and especially a polypropylene substrate, and especially such a substrate where the polymer is in fibre form, coated with a composition of the invention in which the at least one end-capped hydrocarbyl polyalkoxylate is at least one compound of the formula (Ic) and/or (Id). The composition can be the two component composition or a composition including other components.

The two component composition will usually be used as the vehicle for coating a further component or components providing a specific effect over the substrate, particularly the individual fibers of a fibre based textile material. To this end, the composition will usually include at least one such a further component which is compatible with the composition and provides the specific effect that is desired. Thus, in materials such as spin finishes, a lubricant, an antistatic agent, an anticorrosion additive, a cohesion additive, an anti-discolouring (anti-yellowing) additive and/or other material providing a specific effect will be included. Accordingly, the invention includes a composition of the invention including an effective amount of an active component to produce a desired effect. The invention particularly and specifically includes a composition of the invention including an effective amount of a lubricant especially a spin finish lubricant. Additionally, the invention further includes a composition of the invention including an effective amount of at least one antistatic agent, anticorrosion additive. cohesion additive or anti-discolouring (anti-yellowing) additive. Of course, these further components are compatible with the two component spreading vehicle particularly in that the overall composition remains water compatible.

The invention includes as a specific aspect such compositions including further components where the end-capped hydrocarbyl or fatty acid polyalkoxylate is one or more compounds of the formula (Ia), (Ib), (Ic) or (Id) and/or the organopolysiloxane having one or more polyoxyalkylene side chains is one or more compounds of the formula (II).

For spin finish lubricating applications, the lubricant can be any suitable compatible lubricant, particularly an alkoxylate lubricant e.g. alcohol alkoxylate lubricants, acid alkoxylate lubricants and similar materials. Alkoxylate lubricant are particularly useful as they can be made readily compatible with the composition and synthesised to be themselves water soluble or dispersible and are usually biodegradable (or very much more so than mineral oil lubricants). Thus, typically they retain and may even improve the water compatibility of the overall composition and do not adversely affect its relatively good biodegradability properties. Examples of suitable alkoxylate lubricants include alcohol alkoxylates such as alcohol, particularly $C_{8\ to\ 20}$, especially $C_{12\ to\ 18}$ alkoxylates, particularly ethoxylates, typically containing on average from 2 to 20, particularly 3 to 15, especially 5 to 12, moles alkoxide (ethoxide) residues per mole, ethylene oxide (EO)/propylene oxide (PO) copolymers, typically having a weight ratio of EO to PO residues of from about 3:1 to about 1:3, and so-called fatty acid, particularly $C_{8\ to\ 20}$ fatty acid, alkoxylates, especially ethoxylates, typically containing on average from 3 to 20, particularly 5 to 15, especially 8 to 12, moles alkoxide (ethoxide) residues per mole and castor oil alkoxylates, especially ethoxylates. Fatty acid alkoxylates can be made by reacting the fatty acid with an alkylene oxide (usually ethylene oxide) and the product is a mixture of compounds including alkoxylated fatty acid residues with a range of polyoxyalkylene chain lengths and polyoxyalkylene glycols generated by displacement from alkoxylated fatty acid species (by ethylene oxide reacting at the carboxyl function). The numbers of alkylene oxide residues indicated above for such compounds corresponds to the total alkylene oxide reacted in making the product. Even though they are mixtures of compounds, such products are known as lubricants and in this end use it is the effect that is important. Nominally similar products can be made by reacting the fatty acid or a reactive derivative e.g. a lower alkyl, especially methyl, ester, with a polyalkylene glycol, or mono-end capped e.g. lower alkyl, especially methyl or ethyl end-capped, polyalkylene glycol, particularly polyethylene glycol. The products of such reactions are typically well defined products which are polyoxyalkylene glycol esters of the fatty acid (nominal fatty acid alkoxylates). When desired the alkoxylated products (made by either synthetic strategy outlined above) can be end-capped after manufacture by conventional etherification or esterification reactions.

When the alkoxylate lubricants are end-capped they may fall within the range described above for the end-capped alkoxylates used in the two component spreading vehicle e.g. as defined in formulae (Ia to d). In this case the alkoxylate may serve both as part of the spreading vehicle and as a lubricant (alternatively stated, the two component spreading vehicle may itself include a lubricant). Mixtures of lubricants can be used and may be advantageous in some cases.

Other components which may be included in lubricating compositions, especially spin finishes include anti-yellowing surfactants and/or antistatic agents, such as quatemary ammonium surfactants or phosphates, and cohesion additives. such as relatively high molecular weight ethylene propylene oxide co-polymers.

In the two component composition, the silicone glycol is typically present at a concentration of from 3 to 50% with the remainder (50 to 97%) being the end-capped hydrocarbyl or fatty acid, polyalkoxylate. Where the polyalkoxylate is an end-capped alcohol alkoxylate, particularly of the formula (Ia), or an end-capped fatty acid polyalkoxylate, particularly of the formula (Ib), the silicone glycol is usually present as 3 to 30%, more usually 5 to 20%, desirably about 12 to about 18%, by weight, with the remainder corresponding to 97 to 70%. more usually 95 to 80%, desirably about 88 to about 82%, being the end-capped alcohol alkoxylates or fatty acid polyalkoxylate. Where the polyalkoxylate is an end-capped EO/PO copolymer, particularly a random copolymer of the formula (Ic) or a block copolymer of the formula (Id), the silicone glycol is usually present as 15 to 50%, more usually 20 to 55%, desirably about 25 to about 35%, by weight, with the remainder, corresponding to 85 to 50%, more usually 80 to 55%, desirably about 75 to about 65%, being the end-capped EO/PO copolymer. The use of lower amounts of silicone glycol may not give adequate long term spreading and larger amounts are expensive without giving additional benefits and may be positively disadvantageous by making the composition incompatible with water and/or not adequately biodegradable.

In practical formulations including materials having specific activity, the amount of the other materials will depend mainly on the nature and effectiveness of the material used. For lubricants, the proportions will typically be about 35 to about 90% by weight of the total formulation. Where the polyalkoxylate is an end-capped alcohol alkoxylate, particularly of the formula (Ia), or an end-capped fatty acid polyalkoxylate, particularly of the formula (Ib), the proportion of lubricant will usually be from about 35 to about 80%, more usually from 50 to 75%, of the total formulation. Where the polyalkoxylate is an end-capped EO/PO copolymer, particularly a random copolymer of the formula (Ic) or a block copolymer of the formula (Id), the proportion of lubricant can be somewhat higher and will usually be from about 60 to about 90%, more usually 70 to 86%, of the total formulation. In such multi-component formulations, the proportion of the silicone glycol is usually from about 3 to about 10% by weight of the formulation for all the types of capped polyalkoxylate, especially of the formula (Ia to d).

Other materials will be used in amounts depending on the desired effect. Particularly where the specific active component is effective at very low application rates, it may be useful to use lower concentrations than necessary to convey the desired amount in order to apply sufficient material to the substrate to achieve uniform coating. The need for this will depend on the particular coating technique used, the substrate being treated and the usefulness of diluting the formulation e.g. with water.

For use as a lubricating spin finish, the formulation will typically have the quantitative composition (noting the differences between compositions based on compounds of the formulae (Ia) and (Ib) and those based on compounds of the formulae (Ic) and (Id):

| Capped alkoxylate of the formulae (la) or (lb) | | |
|---|---|---|
| Material (all % by weight) | typical | preferred |
| alkoxylate lubricant | 35–80 | 50–75 |
| capped alkoxylate [(la) or (lb)] | 17–45 | 21–42 |
| spreading agent | | |
| silicone glycol | 3–10 | 4–8 |

| Capped alkoxylate of the formulae (lc) or (ld) | | |
|---|---|---|
| Material (all % by weight) | typical | preferred |
| alkoxylate lubricant | 60–90 | 70–86 |
| capped alkoxylate [(1c) or (1d)] | 7–30 | 10–20 |
| spreading agent | | |
| silicone glycol | 3–10 | 4–10 |

When the end capped alkoxylate also serves as the whole or part of the lubricant, the proportion of silicone glycol in the two component spreading vehicle including the alkoxylate may be towards the low end of the ranges set out above. Thus, where the alkoxylate acts entirely as the lubricant, the proportion of silicone glycol will typically be from 3 to 10% by weight of the formulation.

The formulations of the invention can be applied to the substrate neat as liquids or diluted in a suitable diluent or solvent. Whilst organic solvents could be used, we do not expect this to be particularly attractive to users. The most useful solvent or diluent is almost always water, indeed as noted above the present formulations and compositions are water soluble or dispersible as is desirable to permit subsequent removal from the substrate. The concentration of the formulation, in a diluent such as water, will depend on the method of coating to be used and the relative amount of diluted formulation and effective composition needed in the application.

In application to the substrate, some coating methods may give rise to foaming of the coating composition. This can be inhibited by use of an antifoam e.g. a silicone, in the composition.

The amount of composition or formulation of the invention applied to the substrate will depend on the effect desired. However, typically, particularly for spin finish applications such as to lubricate substrates such as spun-bonded non-woven material, particularly made from polyolefin polymers such as polypropylene, or polyester, the amount applied will typically be about 0.5 to 5%, more usually 0.75 to 2.5%, by weight of the substrate.

The invention includes a polymeric substrate having a coating of a composition of the invention, particularly a fibrous substrate in which the individual fibers are coated with the coating composition. In particular the substrate is a non-woven, particularly a spun bonded non-woven, textile material, especially one made from polyolefinic material, especially polypropylene or polyester. Such products find end use applications including carpet backing materials and geotextiles and such end use products are specifically included as aspects of the invention.

In respect of carpet backing the invention specifically includes non-woven, particularly spun bonded non-woven, but also including textile material made from woven tapes, carpet backing material, particularly made from polyester, particularly PET, or, and especially, polyolefin polymers, very particularly polypropylene, which is coated with the composition of the invention, particularly a composition additionally including a lubricant, and optionally other components of spin finish formulations; and the invention further includes carpets, particularly tufted carpets made using it. It is a particular advantage of the invention that spin finishes can be made and used that are readily soluble or dispersible in water and thus do not interfere with typical dyeing processes applied to carpet fabricated using the substrate as backing. Also spin finishes can be made which meet current demands for materials that are primarily biodegradable.

The compositions of the invention can also be used to treat geotextile materials, particularly non-woven, particularly spun bonded non-woven polyolefin, especially polypropylene, geotextiles. The main reason for treating geotextiles is to enhance their rewetting performance so that they do not act as water barriers once they are buried in the earth. Generally, longer term rewettability appears to arise from integration of fine soil particles into the fabric or onto the fibers of the geotextile, but improvement in the, relatively, short term rewetting properties is significant.

The invention also includes methods of treating substrates with compositions of the invention. In particular, it includes such methods in which the composition of the invention is coated onto a surface of a substrate, particularly a textile substrate and especially a non-woven, particularly spun bonded non-woven polyolefin, especially polypropylene substrate, especially where the composition additionally includes a lubricant and optionally other components of spin finish formulations. This method is particularly applicable to carpet backing and geotextile materials.

The following Examples illustrate the invention. All parts (pts) and percentages are by weight unless otherwise specified.

MATERIALS USED

End-capped alcohol alkoxylates

| Code | Description |
|---|---|
| A1 | methyl capped $C_{12\ to\ 18}$ alcohol ethoxylate: $EO_{6.5}$ |
| A2 | di-methyl capped $EO_{22}/PO_{16}$ (EO.PO.EO ternary) block copolymer |
| A3 | propyl capped $C_{13\ to\ 15}$ alcohol alkoxylate: $EO_8/PO_1$ random |
| A4 | methyl capped $C_{12\ to\ 13}$ alcohol ethoxylate: $EO_{6.5}$ |
| A5 | methyl capped $C_{9\ to\ 11}$ alcohol alkoxylate: $EO_5/PO_{7.7}$ random |
| A6 | methyl capped lauric acid ethoxylate: $EO_9$ |

Silicone Glycol

S1 co-polymer of general formula (II) in which: x is ca 100; y is between 10 and 15; $R^3$ is a $C_3$ alkylene group—the residues $AO^2$ are a mixture of ethylene and propylene oxide residues in the ratio ca 1:1, the side chains having an average molecular weight of about 6000 and $R^4$ is an acetyl group.

Lubricants

| Code | Description |
|---|---|
| L1 | lauric acid ethoxylate: $EO_9$ |
| L2 | EO/PO block coploymer lubricant containing 30 wt % EO |
| L3 | EO/PO block coploymer lubricant containing 40 mol % EO |

Cohesion Additive

EP1 high molecular weight ethylene/propylene oxide copolymer (EO/PO ca 3:1 molar)

Carpet Backing—commercially available spun-bonded non-woven polypropylene textile having a basis weight of about 110 $g.m^{-2}$

TEST METHODS

Fibre/Metal Friction (F/M$\mu$)—Polypropylene filament yam (120 decitex) was treated with 1% by weight of the fibre of spin finish. The fibre/metal friction was determined on a Rothschild 'F' meter at 50, 150 and 300 $m.min^{-1}$ the results quoted are the machine read out data.

Fibre/Fibre Friction (F/F$\mu$)—Polypropylene staple fibre was treated with 1% spin finish by weight of the fibre. The fibre was carded to produce a lap and each lap was conditioned at 20(±1)° C., 50(±2)% RH for 24 hours. A 200 to 250 $g.m^{-2}$; 7.5×10 cm sample was cut from each lap and the Fibre/fibre friction measured using the following Sledge Test.

The sledge is a 6.5 cm square of 'Perspex' acrylic resin with its underside coated with 220 grade emery paper. The test bed is at least 25 cm long and is covered with 220 grade emery paper. A conditioned fibre lap sample is laid on the test bed with the fibers lying along the test bed direction and the sledge placed on top of the lap. A 2 kg weight is placed on top of the sledge which is attached to a load wire attached to a moving load cell. The sledge is towed over the lap at a speed of 2.5 $cm.min^{-1}$ until the load cell measurement reaches a steady level (the load is not itself steady as sticking and slipping effects will give a fluctuating instantaneous reading but generally between relatively constant levels). The fibre fibre friction is the average of three replicates of the measured peak load in N.

Fibre Surface Resistivity (SR)—The electrical surface resistivity of fibre laps prepared as for measuring fibre/fibre friction was measured. The result is the mean of 6 measurements (on the same lap) quoted as ohms×$10^9$ (GΩ).

Viscosity (V)—The kinematic viscosity of the neat spin finish composition was measured using a calibrated 'U' tube viscometer at 25° C. The results are given in cSt (1 cSt=$10^{-6}$ $m^2.sec^{-1}$).

Wicking Height (WH)—A length of untreated Carpet Backing was suspended with its lower end immersed in the neat spin finish and the height of capillary wicking in mm was noted after 10 minutes. The textile was removed from the spin finish and stored at 20(±1)° C., 50(±2)% RH for 24 hours. Any change in the location of the wicking front (in mm) was noted. Results are given as the wicking height in mm after 10 minutes and 24 hour storage.

Spreading (Spr)—A drop of neat spin finish was placed on a polypropylene sheet surface and the area covered by the drop was measured after 5 minutes and 5 hours. Spreading is given as the percentage increase in area between the two measurements.

Rewetting Time (RT)—Samples of Carpet Backing were treated with 1% of each spin finish and the samples conditioned as described above for 24 hours. The samples were tested by dropping them onto the surface of distilled water. The time, in seconds, taken for the textile to wet out completely was reported.

Stitch Penetration Force (SPF)—A piece of untreated Carpet Backing was coated on one side with 1% by weight of the textile of neat spin finish. The force needed for a needle to penetrate the fabric from the treated side (TS) was measured 5 minutes after coating using an L & M sew tester. The textile was stored for 1 week and the force needed for a needle to penetrate the fabric from the treated side was re-measured and the force needed for a needle to penetrate the fabric from the untreated side (US) was measured. For each test the results are the percentage of needle penetrations (from a run of 100) in which the measured peak penetration force exceeded 0.75 N.

EXAMPLES 1 to 13

A range of spin finish formulations was made up with the compositions set out in Table 1 below. The spin finish compositions were applied neat to samples of the Carpet Backing at about 1.5% by weight on the Carpet Backing. The composition readily coated uniformly onto the Carpet Backing (allowing for the non-uniform nature of the substrate) and gradually spread to coat the individual fibers of the substrate. The coated substrate was tested in the tests outlined above and compared with otherwise similar control samples which were:

i completely untreated (C1);

ii treated with approx 1.5% by weight Lubricant L1 (with no spreading vehicle) (C2); and iii treated with approx 1.5% by weight of a conventional one component 'silicone glycol' spin finish (C3).

The results of testing are set out in Table 2 below. In addition to the test results in Table 2, the following tests were carried out:

i Samples of the spin finishes were diluted with water to give various concentrations in the range 90 to 10% spin finish. The C2 and Example 1 spin finishes gave solutions or emulsions with no gel formation at all the concentrations tested. The C3 spin finish was incompatible with water and gave two separated phases at all concentrations tested.

ii Samples of undyed nylon carpet were wiped in three separated stripes with neat spin finish, either C3 or the composition of Example 1. The carpet samples were then dyed at 85° C. using Nylomine Brown dye and assessed visually for colour uptake. The carpet treated with C3 spin finish showed three distinct areas of undyed fibre tips; the carpet treated with the compositions of Example 1 was uniformly dyed.

iii The tendency of the Carpet Backing to swell when contacted with the spin finish formulations was assessed. 30×5 cm samples of Carpet Backing were immersed in samples of the spin finish of Examples 11 and 13 at ambient temperature for a period of 3 months. After 1 week, 1 month and at the end of the 3 month period the samples were removed from the spin finish and the sample length measured with a ruler. The 1 week and 1 month samples were replaced in the spin finish and storage at ambient temperature continued. The results are reported in Table 3 below as the % increase in the length of the samples. The sample immersed in the spin finish formulation of Example 11 showed a gradual increase in length over the test period up to 1.7% after 3 months. That of Example 13 showed no increase until the 3 month figure of 0.15% (in practice this is close to the limiting observational precision of the method used).

TABLE 1

| | capped alkoxylkate | | silicone glycol | | lubricant | | cohesive agent | |
|---|---|---|---|---|---|---|---|---|
| Ex No | material | amount | material | amount | material | amount | material | amount |
| 1 | A1 | 20 | S1 | 3 | L1 | 72 | C1 | 5 |
| 2 | A1 | 45 | S1 | 10 | L1 | 40 | C1 | 5 |
| 3 | A1 | 57 | S1 | 6 | L1 | 32 | C1 | 5 |
| 4 | A1 | 15 | S1 | 6 | L1 | 74 | C1 | 5 |
| 5 | A2 | 32 | S1 | 6 | L1 | 57 | C1 | 5 |
| 6 | A3 | 32 | S1 | 6 | L1 | 57 | C1 | 5 |
| 7 | A4 | 32 | S1 | 6 | L1 | 57 | C1 | 5 |
| 8 | A5 | 32 | S1 | 6 | L1 | 57 | C1 | 5 |
| 9 | A6 | 32 | S1 | 6 | L1 | 57 | C1 | 5 |
| 10 | A1 | 32 | S1 | 6 | L2 | 57 | C1 | 5 |
| 11 | A1 | 32 | S1 | 6 | L1 | 57 | C1 | 5 |
| 12 | A1 | 32 | S1 | 6 | L3 | 57 | C1 | 5 |
| 13 | A2 | 15 | S1 | 6 | L1 | 89 | — | — |

TABLE 2

| Ex | F/Mμ | | | F/Fμ | SR | V | WH (mm) | | Sp | RT | SPF (%) | | |
|---|---|---|---|---|---|---|---|---|---|---|---|---|---|
| No | 50 | 150 | 300 | (N) | (GΩ) | (cSt) | I | D | (%) | (sec) | $I_c$ | $D_c$ | $D_u$ |
| C1 | — | — | — | — | >$10^3$ | — | — | — | — | 60 | 100 | 100 | 100 |
| C2 | 0.19 | 0.25 | 0.28 | 6.0 | >$10^2$ | 90 | 10 | 20 | 20 | 5 | 92 | 70 | 47 |
| C3 | 0.17 | 0.2 | 0.23 | 5.8 | >$10^3$ | 180 | 15 | 55 | 50 | 60 | 39 | 28 | 25 |
| 1 | 0.2 | 0.2 | 0.3 | 4.5 | 2 | 95 | 16 | 70 | 30 | 1 | 54 | 32 | 32 |
| 2 | 0.2 | 0.2 | 0.3 | 5.3 | 2 | 105 | 25 | 80 | 50 | 1 | 48 | 29 | 52 |

TABLE 2-continued

| Ex | F/Mμ | | | F/Fμ | SR | V | WH (mm) | | Sp | RT | SPF (%) | | |
|---|---|---|---|---|---|---|---|---|---|---|---|---|---|
| No | 50 | 150 | 300 | (N) | (GΩ) | (cSt) | I | D | (%) | (sec) | $I_c$ | $D_c$ | $D_u$ |
| 3 | 0.2 | 0.2 | 0.3 | 5.5 | 3 | 80 | 25 | 80 | 60 | 1 | 31 | 33 | 33 |
| 4 | 0.2 | 0.2 | 0.2 | 5.3 | 0.7 | 130 | 10 | 65 | 30 | 1 | 58 | 39 | 44 |
| 5 | 0.2 | 0.3 | 0.3 | 4.9 | 2 | 185 | 18 | 40 | 20 | <1 | 28 | 21 | 22 |
| 6 | 0.2 | 0.2 | 0.3 | 4.7 | 3 | 130 | 20 | 60 | 40 | 2 | 51 | 20 | 20 |
| 7 | 0.2 | 0.2 | 0.3 | 4.7 | 2 | 95 | 25 | 70 | 30 | 1 | 66 | 53 | 36 |
| 8 | 0.2 | 0.3 | 0.3 | 5.6 | 5 | 130 | 25 | 55 | 40 | 2 | 29 | 30 | 40 |
| 9 | 0.2 | 0.2 | 0.2 | 4.5 | 2 | 105 | 20 | 60 | 40 | <1 | 55 | 40 | 40 |
| 10 | 0.2 | 0.3 | 0.3 | 4.4 | 50 | 185 | 20 | 55 | 40 | 3 | 33 | 39 | 30 |
| 11 | 0.2 | 0.2 | 0.3 | 4.9 | 2 | 105 | 25 | 70 | 60 | <1 | 40 | 35 | 30 |
| 12 | 0.2 | 0.3 | 0.3 | 5.0 | 40 | 240 | 15 | 40 | 30 | 4 | 44 | 32 | 29 |
| 13 | 0.19 | 0.24 | 0.29 | 5.9 | 1.3 | 115 | 18 | 50 | 60 | 1 | 36 | 28 | 25 |

TABLE 3

| Ex | Change of length (%) | | |
|---|---|---|---|
| No | 1 week | 1 month | 3 months |
| 11 | 1.0 | 1.5 | 1.7 |
| 13 | 0.0 | 0.0 | 0.2 |

We claim:

1. A water compatible surfactant composition which comprises:

i at least one hydrocarbyl end-capped hydrocarbyl polyalkoxylate and/or at least one hydrocarbyl end-capped fatty acid polyalkoxylate; and ii at least one organopolysiloxane having one or more polyoxyalkylene side chains.

2. A composition as claimed in claim 1 wherein the end-capped hydrocarbyl polyalkoxylate is or includes a lower alkyl end-capped alcohol alkoxylate and the end-capped fatty acid polyalkoxylate is or includes a lower alkyl end-capped fatty acid alkoxylate.

3. A composition as claimed in claim 1 wherein the end-capped hydrocarbyl and/or end-capped fatty polyalkoxylate is or includes a compound of the formula (Ia) or (Ib):

$$R^1O.(AO^1)_n.R^2 \quad \text{(Ia)}$$

or $$R^3.CO_2.(AO^1)_n.R^2 \quad \text{(Ib)}$$

where $R^1$ is a $C_{4\ to\ 22}$ hydrocarbyl group;

$R^3$ is a $C_{6\ to\ 20}$ fatty acid residue;

$AO^1$ is an alkylene oxide residue which may vary along the chain;

n is from 2 to 25; and $R^2$ is a $C_{1\ to\ 10}$ hydrocarbyl group.

4. A composition as claimed in claim 1 wherein the end-capped hydrocarbyl polyalkoxylate is an end-capped ethylene oxide/propylene oxide copolymer.

5. A composition as claimed in claim 4 wherein the end-capped ethylene oxide/propylene oxide copolymer is a random copolymer of the formula (Ic) or a block copolymer of the formula (Id):

$$R^{14}O.[EO_i.PO_j].R^{15} \quad \text{(Ic)}$$

$$R^{14}O.(AO^{12})_k.(AO^{13})_l.(AO^{12})_m.R^{15} \quad \text{(Id)}$$

where $R^{14}$ and $R^{15}$ are each independently $C_{1\ to\ 6}$ alkyl groups;

EO is an ethylene oxide residue;

PO is a propylene oxide residue;

$AO^{12}$ is an ethylene oxide or propylene oxide residue $AO^{13}$ is an ethylene oxide or propylene oxide residue, but is different from $AO^2$ i is from 10 to 40;

j is from 10 to 30;

k and m are each from 0 to 30 and k+m is from 10 to 40; and l is from 10 to 30.

6. A composition as claimed in claim 1 wherein the organopolysiloxane having one or more polyoxyalkylene side chains is a compound of the formula (II):

$$R^4{}_3SiO.[R^4{}_2SiO]_x.\{(R^4Si[(O.R^5.(AO^2)_m.R^6]O\}_y.SiR^4{}_3 \quad \text{(II)}$$

where $R^4$ is an alkyl group which may vary along the polymer chain;

x is from 30 to 300;

y is from 1 to 25;

$R^5$ is a $C_{3\ to\ 6}$ alkylene group;

$AO^2$ is an alkylene oxide residue which may vary along the chain;

m is from 50 to 200; and $R^6$ is a hydrogen atom, a $C_{1\ to\ 18}$ hydrocarbyl group, or a $C^{2\ to\ 10}$ acyl group.

7. A composition as claimed in claim 6 wherein the organopolysiloxane has a molecular weight of from 50 to 100 kiloDaltons.

8. A composition as claimed in claim 1 wherein the alkoxylate groups in the end-capped hydrocarbyl polyalkoxylate or fatty acid polyalkoxylate are ethoxylate groups.

9. A composition as claimed in claim 1 wherein the ratio of organopolysiloxane to end-capped hydrocarbyl polyalkoxylate and/or fatty acid polyalkoxylate is from 3 to 97 to 50 to 50 by weight.

10. A composition as claimed in claim 9 wherein i the end-capped hydrocarbyl polyalkoxylate and/or end-capped fatty acid polyalkoxylate is of the formula (Ia) or (Ib):

$$R^1O.(AO^1)_n.R^2 \quad \text{(Ia)}$$

or $R^3.CO_2.(AO^1)_n.R^2$ (Ib)

where $R^1$ is a $C_{4\ to\ 22}$ hydrocarbyl group;

$R^3$ is a $C_{6\ to\ 20}$ fatty acid residue;

$AO^1$ is an alkylene oxide residue which may vary along the chain;

n is from 2 to 25; and $R^2$ is a $C_{1\ to\ 10}$ hydrocarbyl group;

and the ratio is from about 12 to about 88 to about 18 to about 82; or ii the end-capped hydrocarbyl polyalkoxylate is an end-capped ethylene oxide/propylene oxide copolymer of the formula (Ic) or (Id):

$R^{14}O.[EO_i.PO_j].R^{15}$ (Ic)

$R^{14}O.(AO^{12})_k.(AO^{13})_l.(AO^{12})_m.R^{15}$ (Id)

where $R^{14}$ and $R^{15}$ are each independently $C_{1\ to\ 6}$ alkyl groups;

EO is an ethylene oxide residue;

PO is a propylene oxide residue;

$AO^{12}$ is an ethylene oxide or propylene oxide residue $AO^{13}$ is an ethylene oxide or propylene oxide residue, but is different from $AO^2$ i is from 10 to 40;

j is from 10 to 30;

k and m are each from 0 to 30 and k+m is from 10 to 40; and l is from 10 to 30 and the ratio is from about 25 to about 75 to about 35 to about 65.

11. A synthetic polymeric substrate coated with a composition as claimed in claim 1.

12. A coated substrate as claimed in claim 11 wherein the substrate is in fibre form.

13. A coated substrate as claimed in claim 12 wherein the substrate polymer is a polyolefin, a polyamide, a polyester, an acrylic polymer or a blend containing one or more such polymers.

14. A coated substrate as claimed in claim 13 wherein the substrate polymer is polypropylene or polyethylene terephthalate.

15. A coated substrate as claimed in claim 14 wherein the substrate polymer is polypropylene and the coating includes an end-capped ethylene oxide/propylene oxide copolymer which is a random copolymer of the formula (Ic) or a block copolymer of the formula (Id):

$R^{14}O.[EO_i.PO_j].R^{15}$ (Ic)

$R^{14}O.(AO^{12})_k.(AO^{13})_l.(AO^{12})_m.R^{15}$ (Id)

where $R^{14}$ and $R^{15}$ are each independently $C_{1\ to\ 6}$ alkyl groups;

EO is an ethylene oxide residue;

PO is a propylene oxide residue;

$AO^{12}$ is an ethylene oxide or propylene oxide residue $AO^{13}$ is an ethylene oxide or propylene oxide residue, but is different from $AO^2$ i is from 10 to 40;

j is from 10 to 30;

k and m are each from 0 to 30 and k+m is from 10 to 40; and l is from 10 to 30.

16. A coated substrate as claimed in claim 11 wherein the substrate is a spun-bonded non-woven web.

17. A coated substrate as claimed in claim 16 wherein the amount of the coating is from 0.5 to 2.5% by weight of the substrate.

18. A spin finish composition which comprises a composition as claimed in claim 1 additionally containing a further component which is one or more of a lubricant, an antistatic agent, an anticorrosion additive, a cohesion additive and an anti-discolouring agent.

19. A spin finish composition as claimed in claim 18 wherein the further component is or includes an alkoxylate lubricant.

20. A spin finish composition as claimed in claim 19 wherein the alkoxylate lubricant is one or more alcohol alkoxylates, ethylene oxide/propylene oxide copolymers, fatty acid alkoxylates and/or castor oil alkoxylates.

21. A spin finish composition as claimed in claim 20 comprising:

from 35 to 80% by weight alkoxyiate lubricant;

from 17 to 55% by weight end-capped alcohol and/or end-capped fatty acid alkoxylate; and from 3 to 10% by weight of organopolysiloxane having one or more polyoxyalkylene side chains.

22. A spin finish composition as claimed in claim 21 comprising:

from 50 to 75% by weight alkoxylate lubricant;

from 21 to 42% by weight end-capped alcohol and/or end-capped fatty acid alkoxylate; and from 4 to 8% by weight of organopolysiloxane having one or more polyoxyalkylene side chains.

23. A spin finish composition as claimed in claim 20 comprising:

from 60 to 90% by weight alkoxylate lubricant;

from 7 to 30% by weight end-capped ethylene oxide/propylene oxide copolymer of the formula (Ic) or (Id) as defined in claim 5; and from 3 to 10% by weight of organopolysiloxane having one or more polyoxyalkylene side chains.

24. A spin finish composition as claimed in claim 23 comprising:

from 70 to 86% by weight alkoxylate lubricant;

from 10 to 20% by weight an end-capped ethylene oxide/propylene oxide copolymer; and from 4 to 10% by weight of organopolysiloxane having one or more polyoxyalkylene side chains.

25. A coated substrate as claimed in claim 11 wherein the coating is of a spin finish composition which additionally contains a further component which is one or more of a lubricant, an antistatic agent, an anticorrosion additive, a cohesion additive and an anti-discoloring agent.

26. Carpet backing material which comprises a web of spun-bonded non-woven synthetic polymeric material coated with a spin finish composition which comprises a water compatible surfactant composition which comprises:

i at least one end-capped hydrocarbyl polyalkoxylate and/or at least one end-capped fatty acid polyalkoxylate; and ii at least one organopolysiloxane having one or more polyoxyalkylene side chains; and iii an alkoxylate lubricant.

27. Carpet backing material as claimed in claim 26 wherein the end-capped hydrocarbyl polyalkoxylate is or includes a lower alkyl end-capped alcohol alkoxylate and the end-capped fatty acid polyalkoxylate is or includes a lower alkyl end-capped fatty acid alkoxylate.

28. Carpet backing material as claimed in claim 27 wherein the end-capped hydrocarbyl and/or end-capped fatty acid polyalkoxylate respectively is or includes a compound of the formula (Ia) or (Ib):

$$R^1O.(AO^1)_n.R^2 \quad \text{(Ia)}$$

or $$R^3.CO_2.(AO^1)_n.R^2 \quad \text{(Ib)}$$

where $R^1$ is a $C_{4\ to\ 22}$ hydrocarbyl group;

$R^3$ is a $C_{6\ to\ 20}$ fatty acid residue;

$AO^1$ is an alkylene oxide residue which may vary along the chain;

n is from 2 to 25; and $R^2$ is a $C_{1\ to\ 10}$ hydrocarbyl group, and the organopolysiloxane having one or more polyoxyalkylene side chains is a compound of the fornula (II):

$$R^4{}_3SiO.[R^4{}_2SiO]_x.\{(R^4Si[(O.R^5.(AO^2)_m.R^6]O\}_y.SiR^4{}_3 \quad \text{(II)}$$

where $R^4$ is an alkyl group which may vary along the polymer chain;

x is from 30 to 300;

y is from 1 to 25;

$R^5$ is a $C_{3\ to\ 6}$ alkylene group;

$AO^2$ is an alkylene oxide residue which may vary along the chain;

m is from 50 to 200; and $R^6$ is a hydrogen atom, a $C_{1\ to\ 18}$ hydrocarbyl group, or a $C_{2\ to\ 10}$ acyl group.

29. Carpet backing material as claimed in claim 26 wherein the alkoxylate groups in the end-capped hydrocarbyl polyalkoxylate and the end-capped fatty acid polyalkoxylate are ethoxylate groups.

30. Carpet backing material as claimed in claim 27 wherein the end-capped hydrocarbyl polyalkoxylate is a random ethylene oxide/propylene oxide copolymer of the formula (Ic) or a block ethylene oxide/propylene oxide copolymer of the formula (Id):

$$R^{14}O.[EO_i.PO_j].R^{15} \quad \text{(Ic)}$$

$$R^{14}O.(AO^{12})_k.(AO_{13})_l.(AO^{12})_m.R^{15} \quad \text{(Id)}$$

where $R^{14}$ and $R^{15}$ are each independently $C_{1\ to\ 6}$ alkyl groups;

EO is an ethylene oxide residue;

PO is a petpylene oxide residue;

$AO^{12}$ is an ethylene oxide or propylene oxide residue $AO^{13}$ is an ethylene oxide or propylene oxide residue, but is different from $AO^2$ i is from 10 to 40;

j is from 10 to 30;

k and m are each from 0 to 30 and k+m is from 10 to 40; and l is from 10 to 30; and the organopolysiloxane having one or more polyoxyalkylene side chains is a compound of the formula (II):

$$R^4{}_3SiO.[R^4{}_2SiO]_x.\{(R^4Si[(O.R^5.(AO^2)_m.R^6]O\}_y.SiR^4{}_3 \quad \text{(II)}$$

where $R^4$ is an alkyl group which may vary along the polymer chain;

x is from 30 to 300;

y is from 1 to 25;

$R^5$ is a $C_{3\ to\ 6}$ alkylene group;

$AO^2$ is an alkylene oxide residue which may vary along the chain;

m is from 50 to 200; and $R^6$ is a hydrogen atom, a $C_{1\ to\ 18}$ hydrocarbyl group, or a $C_{2\ to\ 10}$ acyl group.

31. Carpet backing material as claimed in claim 26 wherein the alkoxylate lubricant is one or more alcohol alkoxylates, ethylene oxide/propylene oxide copolymers, fatty acid alkoxylates and/or castor oil alkoxylates.

32. Carpet backing material as claimed in claim 26 wherein the spin finish comprises from 35 to 80% by weight alkoxylate lubricant, from 17 to 55% by weight end-capped hydrocarbyl and/or end-capped fatty acid alkoxylate and from 3 to 10% by weight of organopolysiloxane.

33. Carpet backing material as claimed claim 32 wherein the spin finish comprises from 50 to 75% by weight alkoxylate lubricant, from 21 to 42% by weight end-capped hydrocarbyl and/or end-capped fatty acid alkoxylate and from 4 to 8% by weight of organopolysiloxane.

34. Carpet backing material as claimed in claim 30 wherein the spin finish comprises 60 to 90% by weight alkoxylate lubricant; from 7 to 30% by weight end-capped ethylene oxide/propylene oxide copolymer; and from 3 to 10% by weight of organopolysiloxane.

35. Carpet backing material as claimed in claim 34 wherein the spin finish comprises from 70 to 86% by weight alkoxylate lubricant; from 10 to 20% by weight end-capped ethylene oxide/propylene oxide copolymer; and from 4 to 10% by weight of organopolysiloxane.

36. Carpet backing material as claimed in claim 35 wherein the amount of spin finish is from 0.5 to 2.5% by weight of the substrate.

37. A carpet which comprises treating carpet backing material which comprises a web of spun-bonded non-woven synthetic polymeric material coated with a spin finish composition which comprises a water compatible surfactant composition which comprises:

i at least one end-capped hydrocarbyl polyalkoxylate and/or at least one end-capped fatty acid polyalkoxylate; and ii at least one organopolysiloxane having one or more polyoxyalkylene side chains, and additionally contains an alkoxylate lubricant, and in which carpet tufts are inserted into the carpet backing.

* * * * *